US006065170A

United States Patent [19]

Jang

[11] Patent Number: 6,065,170

[45] Date of Patent: May 23, 2000

[54] WASHING MACHINE HAVING A HYBRID SENSOR AND A CONTROL METHOD THEREOF

[75] Inventor: Bong-An Jang, Suwon, Rep. of Korea

[73] Assignee: Samsung Electronics Co., Ltd., Suwon, Rep. of Korea

[21] Appl. No.: 09/206,962

[22] Filed: Dec. 8, 1998

[30] Foreign Application Priority Data

Jul. 16, 1998 [KR] Rep. of Korea ..... 98-28951
Jul. 16, 1998 [KR] Rep. of Korea ..... 98-28953

[51] Int. Cl.[7] ..... D06F 33/02

[52] U.S. Cl. ..... 8/158; 8/159; 68/12.04; 68/12.05; 68/12.06; 68/12.27

[58] Field of Search ..... 8/158, 159; 68/12.04, 68/12.05, 12.06, 12.27

[56] References Cited

U.S. PATENT DOCUMENTS

| | | | |
|---|---|---|---|
| 4,742,698 | 5/1988 | Torita | 68/12.27 X |
| 5,144,819 | 9/1992 | Hiyama et al. | 68/12.05 X |
| 5,743,115 | 4/1998 | Hashimoto | 68/12.06 X |
| 5,850,746 | 12/1998 | Lee | 68/12.06 |

*Primary Examiner*—Philip R. Coe
*Attorney, Agent, or Firm*—Burns, Doane, Swecker & Mathis, L.L.P.

[57] ABSTRACT

A washing machine having a hybrid sensor and a control method therefor simplify the inner structure of the washing machine by using one hybrid sensor for sensing a laundry weight, a feed water weight, and a dynamic unbalance of a washing tub. In a washing machine including a main body; a water tub provided to inside of the main body; a washing tub rotatably mounted to inside of the water tub; and at least one suspension bar having an upper end coupled with an inner wall of the main body and a lower end coupled with an outer wall of the water tub, and supporting the water tub, the washing machine includes: a hybrid sensor which is mounted to the upper end of the suspension bar and generates signals corresponding to a laundry weight, a water level and a dynamic unbalance on the basis of ascending or descending displacement of the suspension bar when the suspension bar is moved up and down by load variation or unbalance rotation of the water tub. As described above, the washing machine having the hybrid sensor senses the laundry weight, the feed water weight, and a dynamic unbalance by using only one hybrid sensor, has a simple structure, and easily performs a signal processing.

13 Claims, 10 Drawing Sheets

WASHING MACHINE HAVING A HYBRID SENSOR AND A CONTROL METHOD THEREOF

BACKGROUND OF THE INVENTION

1. Field of the Invention

The present invention relates to a washing machine having a hybrid sensor and a control method thereof wherein the hybrid sensor can sense a laundry weight, a feed water weight and dynamic unbalance of a washing tub.

2. Description of the Prior Art

In a washing machine, water currents are generated by a pulsator rotated by a motor to exert impact on the laundry, thereby washing the laundry. Washing, rinsing, draining and dehydrating steps are previously programmed in a microcomputer provided for controlling the washing process of a washing machine. When either one of such programs is selected by the user, the laundry is automatically washed according to the selected program.

That is, the washing machine senses the weight of the laundry placed in the washing tub, sets an appropriate water level corresponding to the sensed laundry weight, supplies water to the set water level, and performs washing and rinsing steps. After the rinsing step, the washing machine performs the dehydrating step by which the washing process is completed. In order to achieve a fully automatic washing process, a sensor for detecting the laundry weight, a sensor for detecting a feed water weight and a sensor for detecting dynamic unbalance of the washing tub are all needed for a conventional washing machine.

FIG. 1 is a cross-sectional view of a conventional washing machine having the aforementioned three sensors.

As shown in FIG. 1, the conventional washing machine includes: a laundry weight sensor 10 for sensing a laundry weight; a water level sensor 20 for determining if water is supplied to a water level predetermined in response to the sensed laundry weight; and an unbalance sensor 30 for sensing dynamic unbalance of a washing tub 3.

The laundry weight sensor 10 includes: a permanent magnet 11 being fixedly mounted to a pulley 6 of a washing motor 5, and being rotated with the washing motor 5; and a coil 12 for generating a variable electrical signal as it approaches the permanent magnet 11. The sensor 10 senses the weight of the laundry by utilizing the fact that when the moter 5 is further rotated by inertial force after stopping, the number of its rotation is varied upon the weight of the laundry. That is, if the user puts the laundry in the washing tub and turns on a power switch, a control unit (not shown) of a washing machine rotates the washing motor 5 during a given time and then stops the washing motor 5. As a result, the washing motor 5 is further rotated by inertial force.

The laundry weight is obtained by counting the number of signal pulses generated from the coil 12 magnetized by the permanent magnet 11 during the inertial rotation. If the laundry weight is determined, the control unit sets an appropriate water level according to the laundry weight.

The water level sensor 20 includes: an air trap 21 provided to a lower portion of the water tub 2, the inner air of which is compressed in response to a water level; and a mechanical pressure sensing member 22 for generating variable frequencies ranging from 22 kHz to 26 KHz according to the air pressure of the air trap 21. In operation of the water level sensor 20, as the level of water in the water tub 2 rises by supplying water into the washing machine, the air in the air trap 21 is compressed and exerts a pressure to the mechnical pressure sensing member 22, thereby generating variable frequencies of the range of 26 kHz–22 kHz.

Such a variable frequency is input to the control unit, and the control unit recognizes the present water level. If the present water level reaches to a predetermined water level corresponding to the laundry weight sensed by the sensor 10, the water supply is stopped, and the washing, rinsing and dehydrating steps are sequentially performed.

The unbalance sensor 30 includes: a lever 31 which is apart from an upper end of the water tub 2 for sensing an abnormal motion of the water tub 2 due to an unbalance rotation of the washing tub 3; and a switch 32 which is connected to one end of the lever 31 and generates an on-signal according to the movement of the lever 31 or the opening of the washing machine's door.

If the water tub 2 is swung by unbalance rotation of the washing tub 3 and then operates the lever 31, the switch 32 generates on-signals and the control unit recognizes the unbalance rotation of the washing tub 3 by analyzing the on-signals.

In the meantime, reference numerals 1, 4 and 8 are a main body, a pulsator and suspension bars, respectively.

However, since such a conventional washing machine should be provided with the various sensors aforementioned, namely, a laundry weight sensor, a water level sensor and an unbalance sensor, the production cost of a washing machine is increased, and its inner structure becomes complicated, thereby causing more fabrication steps.

In addition, since the laundry weight sensor 10 senses the laundry weight by utilizing inertial force, it is difficult to measure an accurate laundry weight when the laundries are unevenly distributed in the washing tub 3. If the laundry weight is inaccurately sensed, an optimum feed water weight corresponding to the accurate laundry weight can not be set, thereby lowering the cleaning effect of the laundry.

SUMMARY OF THE INVENTION

The present invention has been made in an effort to solve the above problems. It is an object of the present invention to provide a washing machine having a hybrid sensor that can sense a laundry weight, a water level and a dynamic unbalance of a washing tub, and control method thereof by which the inner structure of the washing machine is very simplified.

To achieve the above object, in a washing machine including a main body; a water tub provided in the main body; a washing tub rotatably mounted in the water tub; and at least one suspension bar having an upper end coupled to an inner upper portion of the main body and a lower end coupled to an outer lower portion of the water tub, the washing machine further includes a hybrid sensor which is mounted to the upper end of the suspension bar and generates signals corresponding to a laundry weight, a water level and a dynamic unbalance on the basis of ascending or descending displacement of the suspension bar when the suspension bar is moved up and down by load variation or unbalance rotation of the water tub.

The hybrid sensor includes: a housing; a permanent magnet vertically moved with the suspension bar in the housing according to load variation of the water tub; an elastic member which is provided below the permanent magnet and is compressed in proportion to the load applied to the water tub; a hall element which is disposed so as to face the upper surface of the permanent magnet at a predetermined distance and generates a voltage signal corresponding to the magnetic force varied by the motion of the permanent magnet; a signal amplifier for amplifying the voltage signal generated from the hall element so as to achieve a proper signal processing; a signal converting portion which receives an amplified voltage signal from the signal amplifier and converts the amplified voltage signal, which is in inverse proportion to the distance between the permanent magnet and the hall element, to be in proportion to the distance; and an output line for outputting an output signal of the signal converting portion to the outside.

In a washing machine including: a main body; a water tub provided to inside of the main body; a washing tub rotatably mounted to inside of the water tub; at least one suspension bar for supporting the water tub; and a hybrid sensor which generates electric signals in response to an ascending or descending displacement of the suspension bar, a method for controlling the washing machine having the hybrid sensor includes the steps of:

a) if a plurality of laundries are initially put into the washing tub after a power-supply is applied to the washing machine, sensing an initial output voltage of the hybrid sensor, and determining a weight of the laundries;

b) determining an optimum feed water weight corresponding to the sensed laundry weight;

c) if the output voltage of the hybrid sensor raises due to a water supply step start, determining a voltage difference between a raised output voltage and the initial output voltage as a present feed water weight, and continuously performing a water supply step until the optimum feed water weight is satisfied;

d) if the output voltage of the hybrid sensor is lowered due to a drain step start, determining a lowered output voltage as a present drain weight, and continuously performing the drain step until the completion of the drain operation is determined; and e) if a dehydration step starts after the drain step, sensing an output voltage of the hybrid sensor due to a suspension bar's displacement generated in a plurality of intermittent dehydration steps involved in the dehydration step, determining whether there is an unbalance by using the output voltage of the hybrid sensor, and controlling a dehydration operation.

BRIEF DESCRIPTION OF THE DRAWINGS

Further objects and other advantages of the present invention will become apparent from the following description in conjunction with the attached drawings, in which.

DETAILED DESCRIPTION OF THE PREFERRED EMBODIMENTS

A preferred embodiment of the present invention will now be described in detail with reference to the accompanying drawings.

Figure 1:
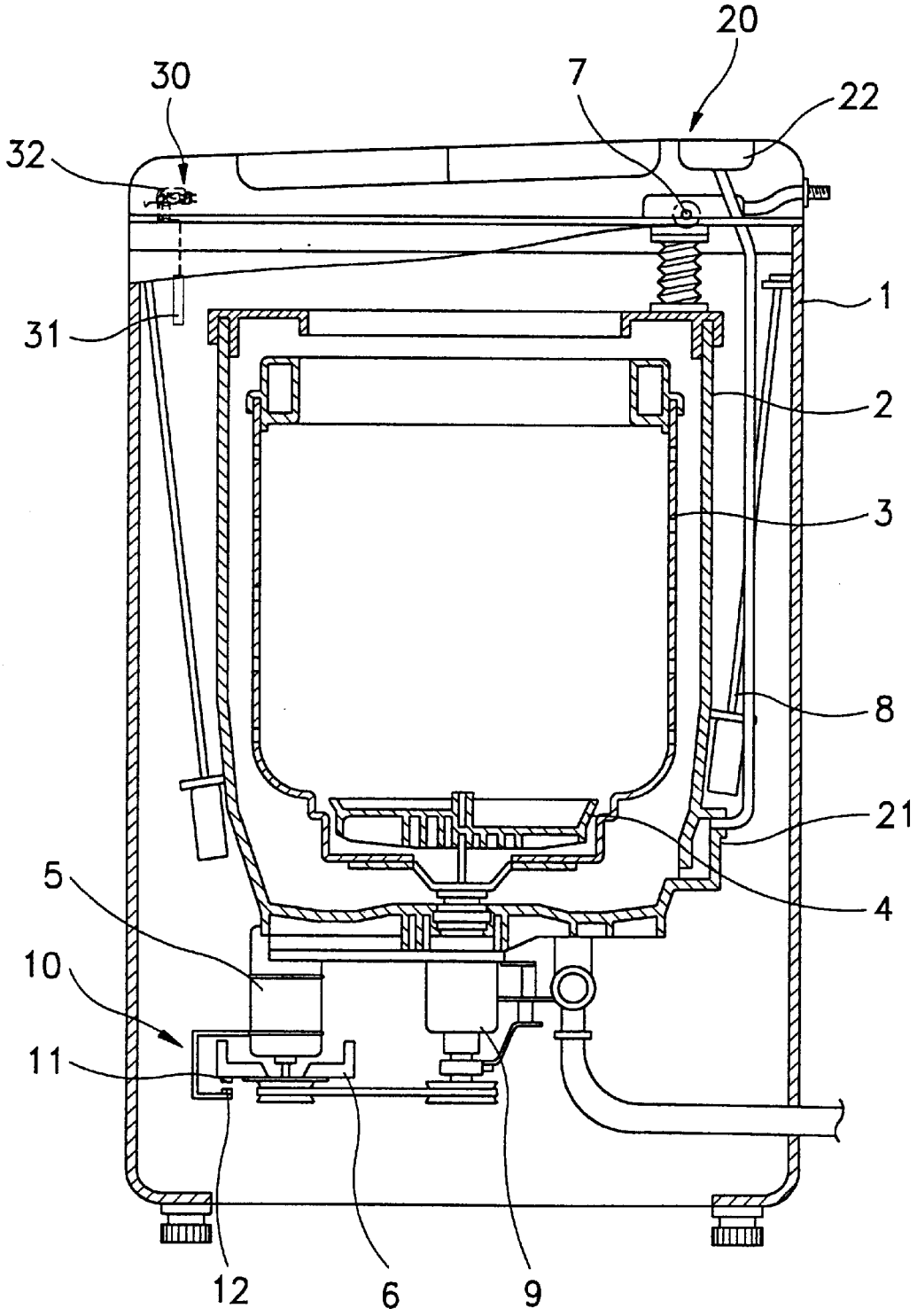
FIG. 1 (PRIOR ART)
FIG. 1 is a cross-sectional view of a conventional washing machine having all of a laundry weight sensor, a water level sensor and an unbalance sensor.
Figure 2:
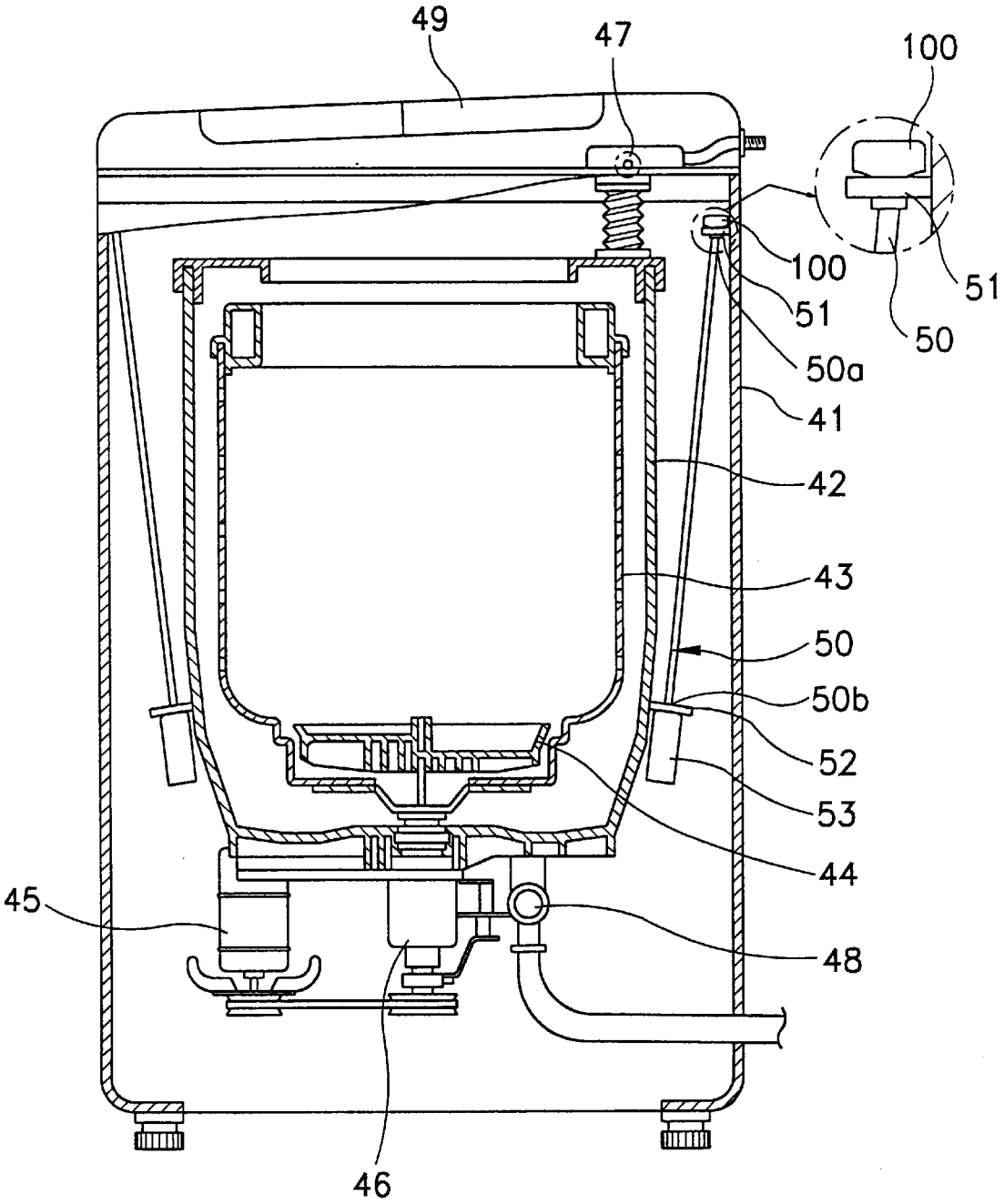
FIG. 2 is a cross-sectional view of a washing machine having a hybrid sensor according to the present invention.
Figure 3:
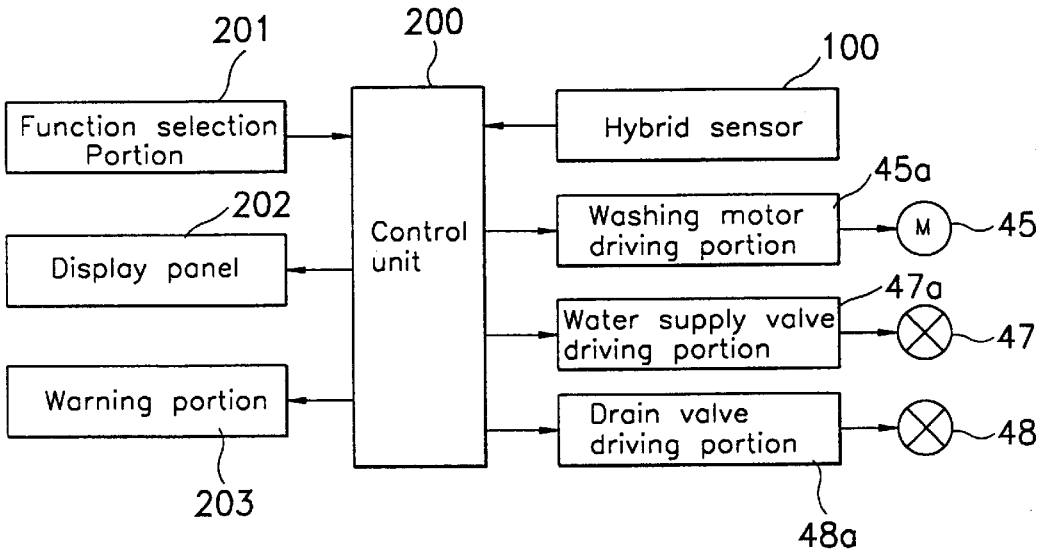
FIG. 3 is a block diagram of a washing machine having the hybrid sensor according to the present invention.

FIG. 2 is a cross-sectional view of a washing machine having a hybrid sensor according to the present invention, and FIG. 3 is a block diagram of a washing machine having the hybrid sensor according to the present invention.

As shown in FIG. 2, the washing machine includes: a main body 41; a door 49 placed on the top of the main body 41; a water tub 42 provided in the main body 41; a washing tub 43 rotatably mounted in the water tub 42; a pulsator 44 which is mounted to the bottom of the washing tub 43 and forwardly or backwardly rotated to generate water currents; a washing motor 45 provided below the water tub 42; a power transmission apparatus 46 which is mounted to the center of an outside bottom of the water tub 42 and transmits the torque of the washing motor 45 to the pulsator 44 at a low speed during the washing step or to both the washing tub 43 and the pulsator 44 at a high speed during the dehydrating step.

The washing machine further includes: a water supply valve 47 which is connected to an outer water supply source to supply water to the water tub 42; a drain valve 48 for draining the water in the water tub 42 to the outside; at least one suspension bar 50 having an upper end 50*a* coupled to an inner upper portion of the main body 41 and the lower end 50*b* coupled to an outer lower portion of the water tub 42 to support the water tub 42; and a hybrid sensor 100 which is mounted to the upper end 50*a* of the suspension bar 50 to generate signals corresponding to a laundry weight, a feed water weight, and dynamic unbalance of the washing tub 43 on the basis of the suspension bar 50's ascending or descending displacement caused by load variation of the water tub 42.

As shown in FIG. 3, the washing machine further includes: a function selection portion 201 for receiving a function command from the user as an input; a display panel 202 for displaying a selected function of the function selection portion 201 and the present operation thereon; a warning portion 203 for warning an abnormal status of the washing machine; a control unit 200 which receives an output signal of the hybrid sensor 100 as an input and determines a laundry weight, a feed water weight and dynamic unbalance on the basis of the output signal of the hybrid sensor 100, and generates control signals; a washing motor driving portion 45*a* for controlling the washing motor 45 in order to generate water currents and to perform the dehydration operation according to the output signal of the control unit 200; a water supply valve driving portion 47*a* for controlling the water supply valve 47 in order to achieve the water supply operation according to the output signal of the control unit 200; and a drain valve driving portion 48*a* for controlling the drain valve 48 in order to achieve the drain operation according to the output signal of the control unit 200.

In addition, as a structure to support the water tub 42 with the suspension bar 50, the washing machine further includes: a fixing member 51 which has a penetration hole to penetrate the upper end 50*a* of the suspension bar 50 to fix the suspension bar 50 to an inner wall of the main body 41; and a bed 52 which has a penetration hole in order to couple the lower end 50*b* of the suspension bar 50 with an outer lower portion of the water tub 42.

A reference numeral 53 indicates a damper 53 for absorbing vibrations.

The load exerting to the suspension bar 50 is varied depending on the weight of the laundry and water placed in the water tub 42, and the shaking of the water tub 42 generated during the dehydration operation. The varied load is transmitted to the hybrid sensor 100 mounted on the suspension bar 50. The hybrid sensor 100 receives the load variation applied to the suspension bar 50 as an input and senses a laundry weight, a feed water weight, and dynamic unbalance on the basis of the load variation.

Figure 4:
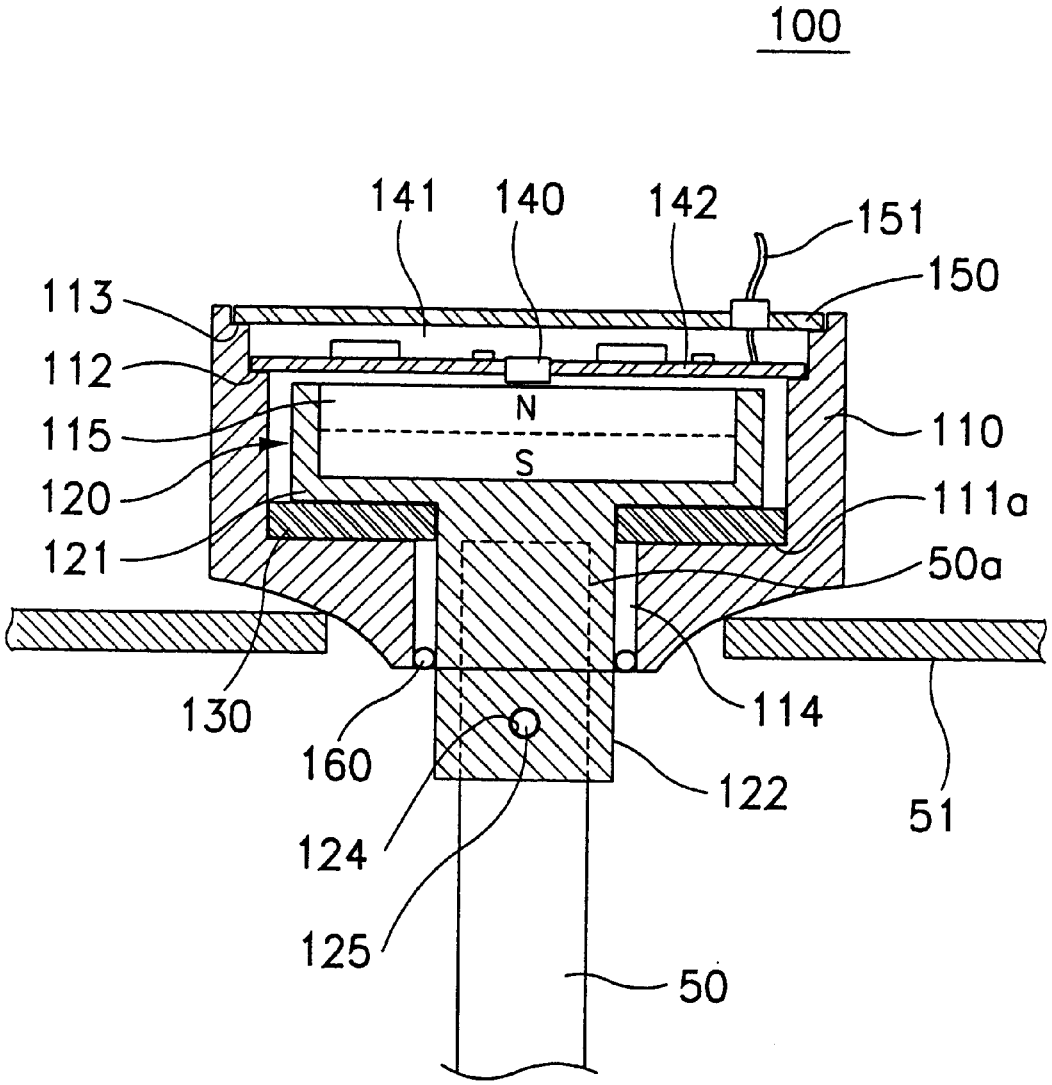
FIG. 4 is a cross-sectional view of the hybrid sensor according to the present invention.
Figure 5:
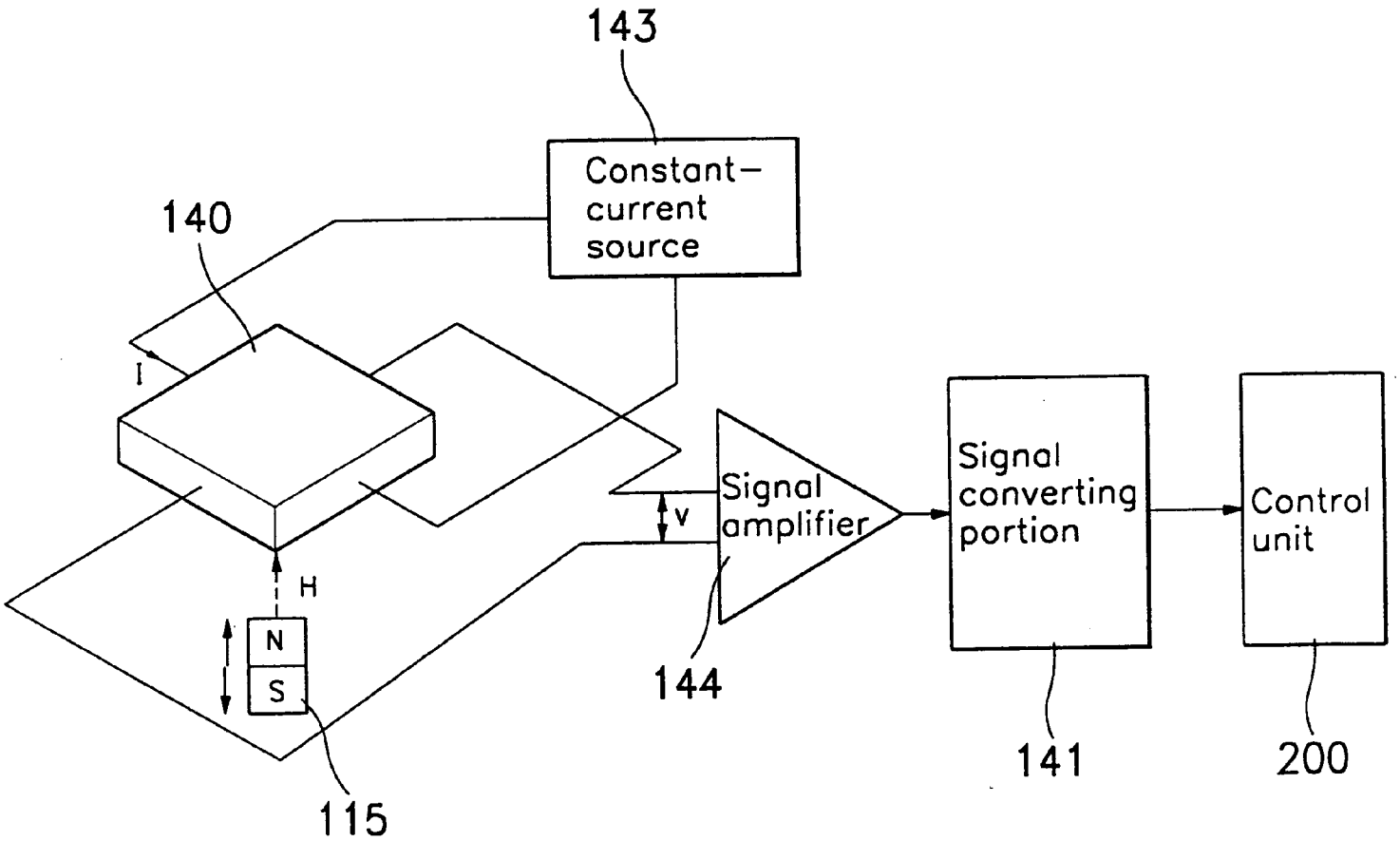
FIG. 5 is a circuit diagram showing a basic principle of the hybrid sensor according to the present invention.

FIG. 4 is a cross-sectional view of the hybrid sensor 100 and FIG. 5 is a circuit diagram showing a basic principle of the hybrid sensor 100.

Referring to FIGS. 4 and 5, the hybrid sensor 100 includes: a housing 110; a permanent magnet 115 which is provided in the housing 110 and vertically moved with the suspension bar 50 according to the load variation of the water tub 42; an elastic member 130 which is provided between the bottom 111*a* of the housing 110 and the permanent magnet 115 and compressed in proportion to the load of the water tub 42; and a hall element 140 which is mounted to be faced with the upper surface of the permanent magnet 115 at a predetermined distance and generates voltage signals corresponding to the magnetic force varied by the motion of the permanent magnet 115.

The hybrid sensor 100 further includes: a signal amplifier 144 for amplifying voltage signals generated from the hall element 140 so as to achieve a proper signal processing; a signal converting portion 141 which receives an amplified voltage signal from the signal amplifier 144 as an input and converts the amplified voltage signal, which is in inverse proportion to a distance between the permanent magnet 115 and the hall element 140, to be in proportion to the distance; a printed circuit board 142 which contains the hall element 140, the signal amplifier 144 and the signal converting portion 141 therein and is fixedly mounted to the inside of the housing 110; a cover 150 which is provided to the top of the housing 110 to cover the inside of the housing 110; and an output line 151 for transmitting signals processed in the signal converting portion 141 to the control unit 200.

A first projection 112 to seat the printed circuit board 142 thereon and a second projection 113 to seat the cover 150 thereon are provided to the inside of the housing 110.

The first projection 112 is provided at an appropriate position in order that the hall element 140 is apart from the highest point of the motion range of the permanent magnet 115 at a predetermined distance. The second projection 113 is also apart from the first projection 112 at a predetermined distance in order to mount a signal converting portion 141 on the printed circuit board 142.

The permanent magnet 115 and the upper end 50*a* of the suspension bar 50 are coupled to each other by a reception member 120.

The reception member 120 includes: a seating member 121 for seating the permanent magnet 115; and a hollow coupling rod 122 which is extended from the lower end of the seating member 121 to the outside of an opening 114 formed at the lower end of the housing 110 to contain the upper end 50*a* of the suspension bar 50. Pin holes 124 are horizontally provided at the upper end 50*a* of the suspension bar 50 and a lower portion of the coupling rod 122, respectively.

Since a fixing pin 125 is inserted into the pin holes 124, the reception member 120 and the upper end 50*a* of the suspension bar 50 are connected to each other. Accordingly, the permanent magnet 115 is positioned in such a manner that it is capable of moving with the suspension bar 50.

Since the diameter of the coupling rod 122 is smaller than that of the opening 114, a gap is created between the coupling rod 122 and the opening 114. To seal the gap, a sealing member 160 is provided.

Referring to FIG. 5, a constant-current I is applied from a constant-current source 143 to the hall element 140, and a magnetic field H making a right angle with the constant-current source I is also applied to the hall element 140. As a result, an output terminal of the hall element 140 generates linearly voltage signals corresponding to the magnetic force of the magnetic field H.

That is, if the permanent magnet 115 is accessed to the hall element 140, the magnetic field H becomes intensified, and thus a voltage signal from the hall element 140 becomes increased.

On the contrary, if the permanent magnet 15 is far away from the hall element 140, the magnetic field H becomes weakened, and thus a voltage signal from the hall element 140 becomes lowered.

Herein, a smaller distance between the permanent magnet 115 and the hall element 140 means that the load applied to the suspension bar 50 becomes reduced. Accordingly, as the load applied to the suspension bar 50 is lowered, the hall element 140 generates a higher voltage signal. On the contrary, a larger distance between the permanent magnet 115 and the hall element 140 means that the load applied to the suspension bar 50 becomes increased. Accordingly, as the load applied to the suspension bar 50 becomes increased, the hall element 140 generates a lower voltage signal.

Figure 6A:
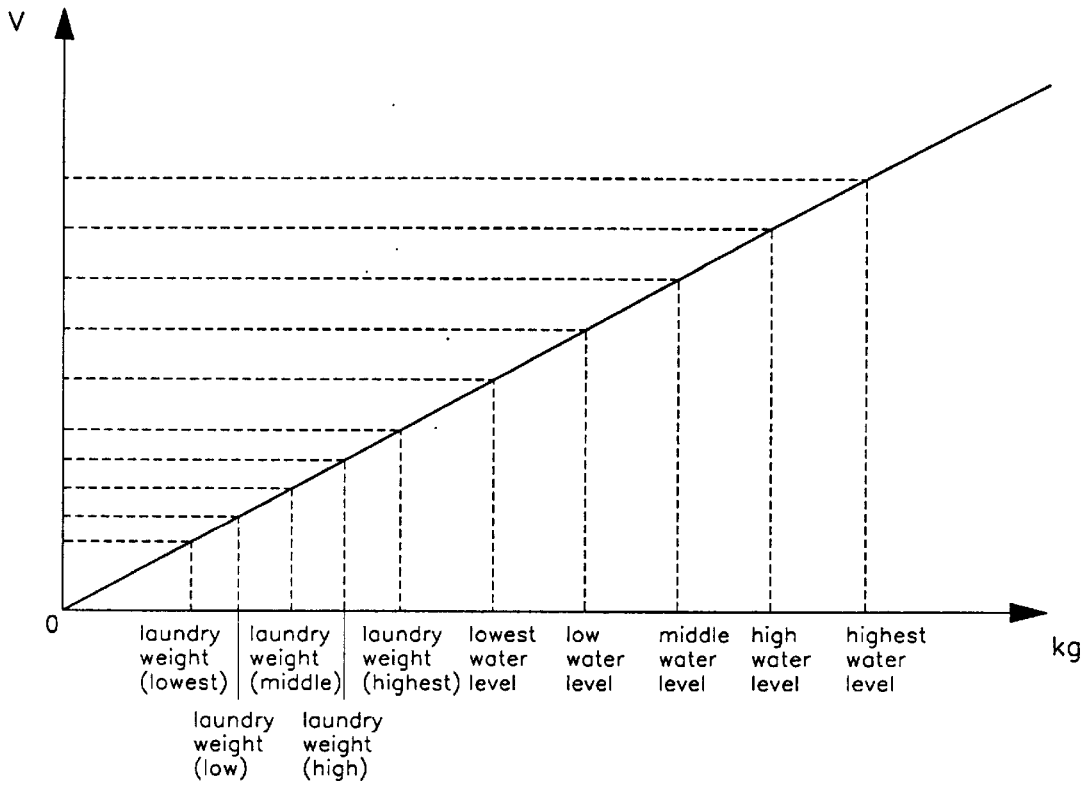
FIGS. 6A–6B show output characteristics of the hybrid sensor according to the present invention.

If such output signal of the hall element 140 is inverse-transformed by the signal converting portion 141, an output voltage shown in FIG. 6A appears. As a result, the output voltage signals of the hybrid sensor 100 are varied in proportion to the loads applied to the suspension bar 50.

The control unit 200 receives the voltage signals and determines the laundry weight, determines a feed water weight based on the sensed laundry weight, reads the output signal of the signal converting portion 141 during a water supply operation, and thus determines the present feed water weight.

An output voltage signal of the hybrid sensor 100 every intermittent dehydration step is applied to an analog-to-digital (A/D) conversion terminal of the control unit 200, and is converted into the digital value by the A/D conversion terminal. Therefore, the control unit 200 determines an unbalance. In more detail, based on the fact that an initial voltage characteristic of the hybrid sensor 100 is changed in response to an unbalance degree, the hybrid sensor 100's output voltage being generated every intermittent dehydration is numerically expressed as an unbalance weight through an experiment. For example, if the user measures the output voltage of the hybrid sensor 100 when the load applied to the suspension bar 50 is 0.1 Kg, an unbalance weight can be calculated by applying the measured output voltage to the output voltage of the hybrid sensor 100 during the intermittent dehydration.

Figure 6B:
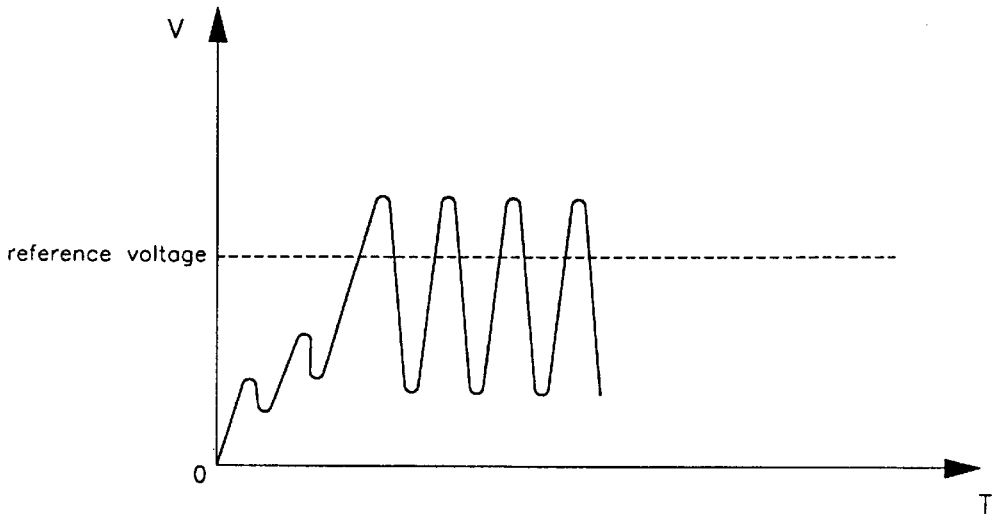

The signal converting portion 141 generates a voltage signal shown in FIG. 6B during the intermittent dehydration.

In more detail, if an unbalance rotation of the washing tub 43 occurs by the unevenly-placed laundries, the water tub 42 is shaken, the suspension bar 50 is moved up and down, a position of the permanent magnet 115 in the hybrid sensor 100 becomes changed, and finally a distance between the hall element 140 and the permanent magnet 115 becomes changed. At this time, the hall element 140 generates a pulse-type voltage signal as shown in FIG. 6B.

This voltage signal is applied to the control unit 200 through the signal converting portion 141. If a voltage signal higher than a predetermined reference voltage for determining an unbalance is input to the control unit 200, an unbalance can be sensed by applying the hybrid sensor 100's output voltage per a reference load to this voltage signal higher than the predetermined reference voltage.

A control method of a washing machine having the hybrid sensor 100 will now be described with reference to FIGS. 7–9.

Figure 7:
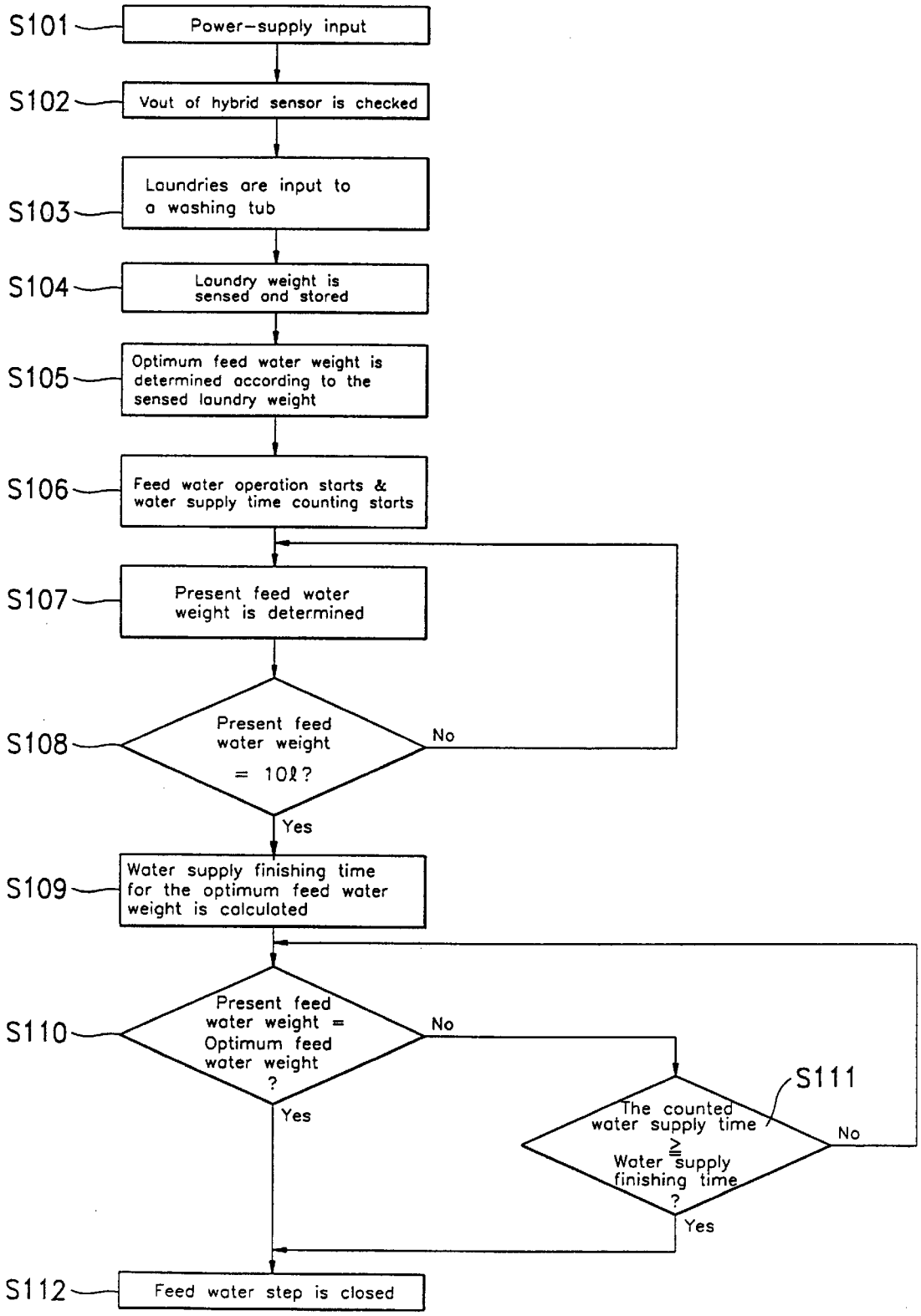
FIG. 7 is a flowchart illustrating a control method of a washing machine having the hybrid sensor according to the present invention, which is applied to a water supply step from a power-supply step.

FIG. 7 is a flowchart illustrating a control method in a water supply step after a power-supply is applied to a washing machine having the hybrid sensor 100.

Referring to FIG. 7, if a power-supply is applied to the washing machine (S101), the control unit 200 checks an initial output voltage Vout of the hybrid sensor 100 before putting the laundry into the washing tub 43 (S102). If the user puts the laundry into the washing tub 43 (S103), the load applied to the suspension bar 50 becomes heavier as much as the laundry weight, and thus an output voltage of the hybrid sensor 100 becomes higher than the initial voltage signal.

Likewise, if the output voltage Vout of the hybrid sensor 100 becomes changed, the control unit 200 determines the laundry weight by using a voltage difference between the two voltages, and stores it (S104).

The control unit 200 determines an optimum feed water weight on the basis of the sensed laundry weight (S105), applies a control signal to the water supply valve driving portion 47*a* in order to open the water supply valve 47, and starts a water supply operation simultaneously with counting a water supply time (S106).

If the water supply operation starts, the weight of water provided into the water tub 42 is transmitted to the suspension bar 50, thereby more raising the output voltage Vout of the hybrid sensor 100. The control unit 200 successively reads an output voltage Vout raised by the water supply operation, compares the raised output voltage with the initial output voltage of the step S102, and thus determines the present feed water weight (S107).

The control unit 200 determines (Sl08) whether the present feed water weight sensed in the step S107 reaches to a predetermined reference feed water weight of 10 liter(s).

If the present feed water weight reaches to 10 liter(s) in the step S108, the control unit 200 measures a duration time from a water supply starting time to a water supply time at which the present feed water weight reaches to 10 liter(s). On the basis of the duration time, a water supply finishing time for the optimum feed water weight determined in the step S105 is calculated (S109).

However, if the present feed water weight is not reached to 10 liter(s) in the step S108, the step S108 returns to the step S107.

After the water supply finishing time is calculated in the step S109, the step S110 determines whether the present feed water weight reaches to the optimum feed water weight determined in the step S105.

If the present feed water weight reaches to the optimum feed water weight in the step S110, the control unit 200 outputs a control signal to the water supply valve driving portion 47*a*, closes the water supply valve 47, and thus stops the water supply operation (S112).

If the present feed water weight is not reached to the optimum feed water weight in the step S110, the step S111 determines whether the counted water supply time is over the water supply finishing time determined in the step S109.

If the counted water supply time is over the water supply finishing time in the step S111, a control signal is applied to the water supply valve driving portion 47*a* in order to close the water supply valve 47, and thus a water supply operation is terminated (S112). The step S111 is provided to prevent an excessive water supply operation.

After finishing the water supply operation, the washing machine performs a washing step, and then performs a drain step.

Figure 8:
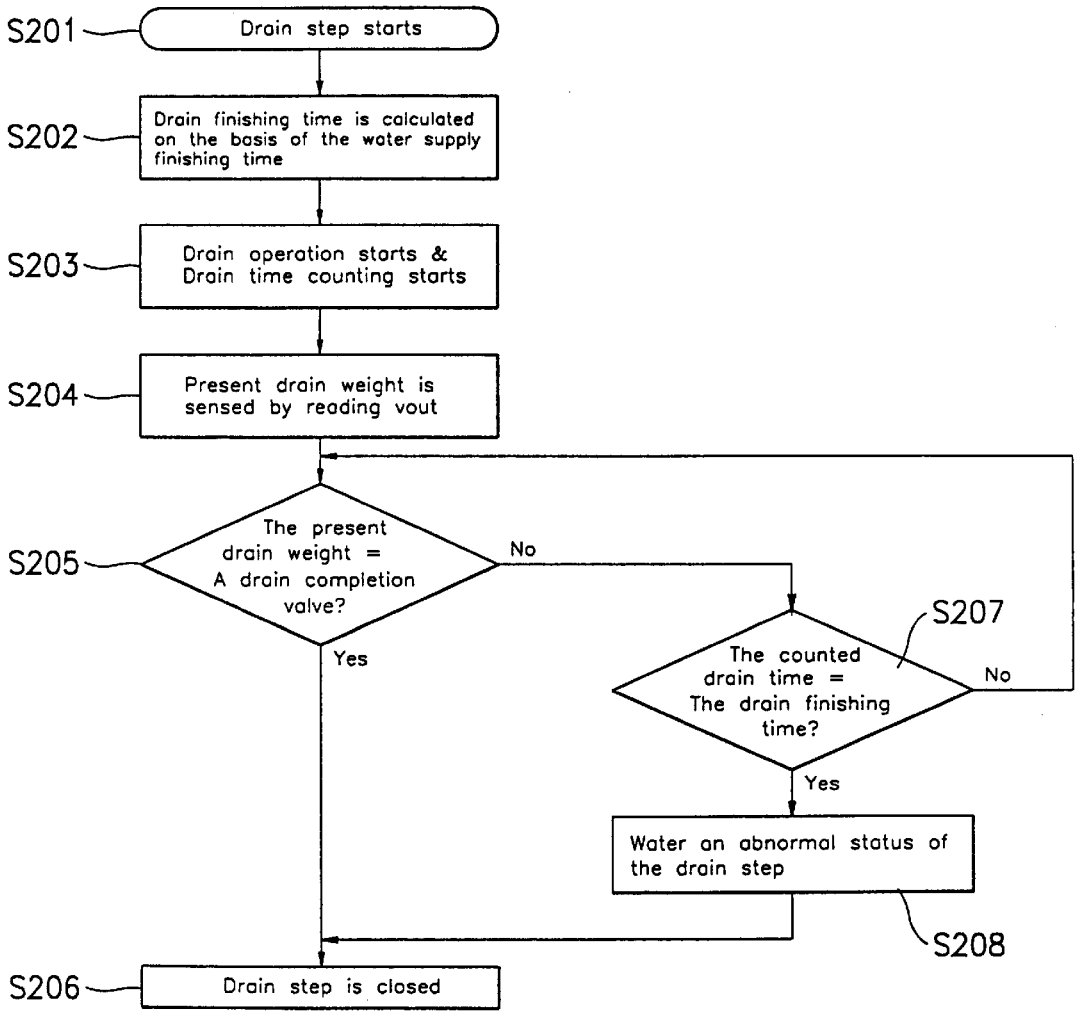
FIG. 8 is a flowchart illustrating a control method of the washing machine according to the present invention, which is applied to a drain step.

FIG. 8 is a flowchart illustrating a control method of the washing machine in such drain step.

As shown in FIG. 8, if the drain step starts (S201), the control unit 200 calculates a drain finishing time on the basis of the water supply finishing time determined in the step S109 of FIG. 7 (S202). At this time, the drain finishing time is determined to be shorter than the water supply finishing time, because all of the initially-provided water cannot be drained to the outside due to the laundries absorbing a little amount of water.

Subsequently, a control signal is output to a drain valve driving portion 48*a* in order to open the drain valve 48, and counts a drain time simultaneously with opening the drain valve 48 (S203).

If the water in the water tub 42 is drained to the outside, the load exerting to the suspension bar 50 is reduced. If the reduced weight is applied to the suspension bar 50, the suspension bar 50 becomes raised by a restoring force of the elastic member 130, the permanent magnet 115 mounted in the reception member 120 coupled with the upper end 50*a* of the suspension bar 50 is also moved upward, thereby narrowing a distance between the hall element 140 and the permanent magnet 115. As a result, the output voltage of the hybrid sensor 100 becomes lowered as the water in the water tub 42 is drained to the outside. The control unit 200 continuously reads the output voltage of the hybrid sensor 100, compares the read output voltage with another voltage stored before starting the drain step, thereby determining a present drain weight (S204]).

Then, a step S205 determines whether the present drain weight reaches to a predetermined reference value (i.e, a drain completion value). Here, the drain completion value is determined in consideration of a status of the laundry absorbing the water therein.

If the present drain weight reaches to the drain completion value in the step S205, the control unit 200 outputs a control signal to the drain valve driving portion 48*a*, closes the drain valve 48, and stops a drain step (S206).

If the present drain weight is not reached to the drain completion value in the step S205, the control unit 200 determines whether the counted drain time is over the drain finishing time determined in the step S202 (S207).

If the counted drain time is over the drain finishing time in the step S207, the control unit 200 warns the user of an abnormal status of the drain step through a warning portion 203 (S208), and compulsorily stops the drain step (S206).

In the meantime, if the counted drain time is not reached to the drain finishing time in the step S207, the step S207 returns to the step S205.

After performing such drain step, a rinsing step is performed, and a dehydration step is finally performed.

A method for sensing an unbalance weight by using the hybrid sensor 100 will now be described with reference to FIGS. 9A–9B.

During three or four intermittent dehydration steps involved in the dehydration step, the control unit 200 determines an unbalance weight by reading an output signal of the hall element 140 via the signal converting portion 141. The dehydration step includes the three or four intermittent dehydration steps and a main dehydration step. The intermittent dehydration step prevents a damage of the washing motor 45 due to an overload, makes the laundries be unevenly placed in the washing tub 43, and previously prevents an unbalance during the dehydration step. However, if the laundries are excessively leaned to one side, the intermittent dehydration step cannot solve this state of the laundries. In other words, the washing tub 43 may be unbalancedly rotated under this intermittent dehydration step, because the laundries are excessively leaned to one side. In this case, the unbalance weight is sensed to determine whether the dehydration step is performed again, and is effectively sensed in the third intermittent dehydration step or fourth intermittent dehydration step.

Figure 9A:
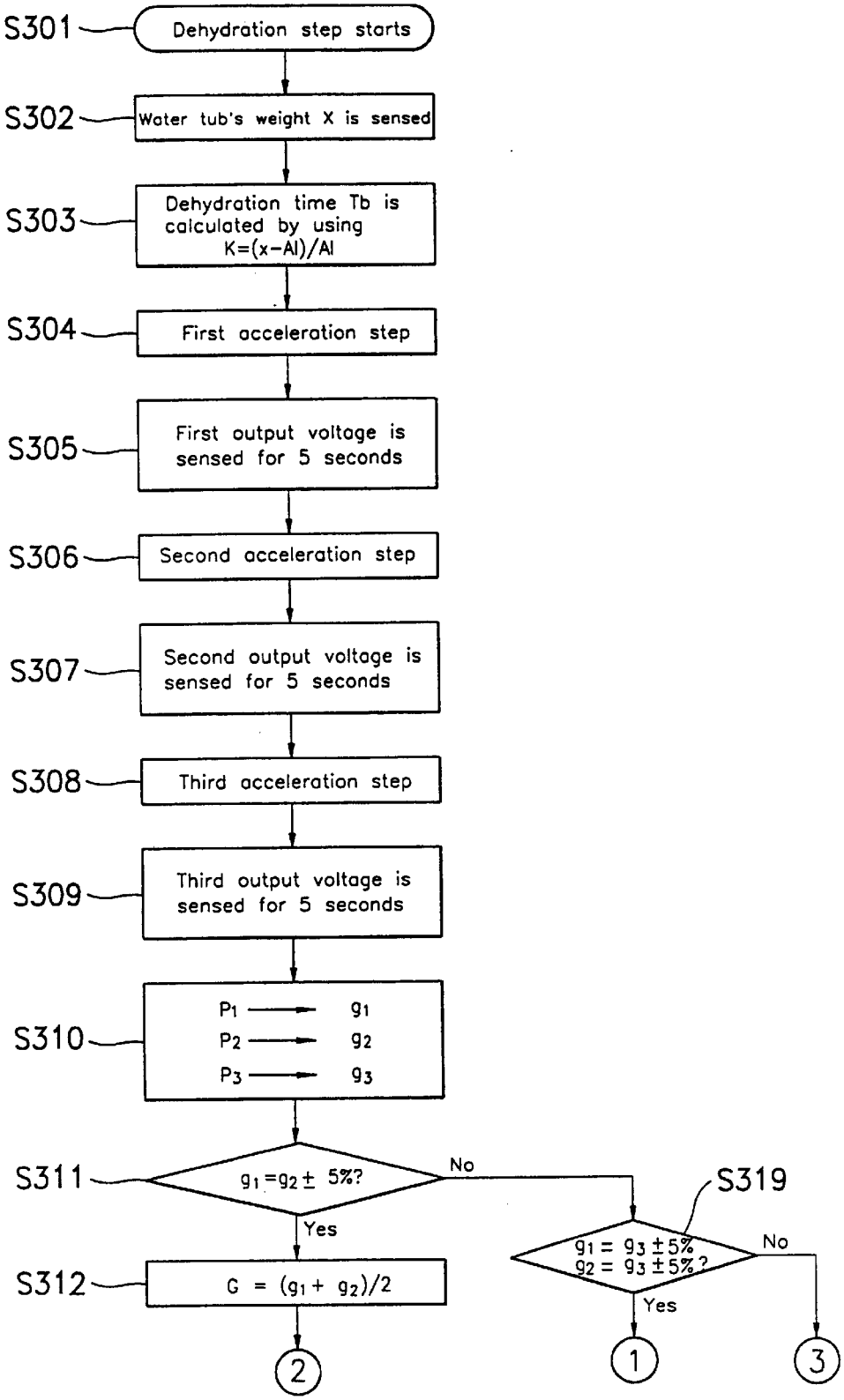
FIGS. 9A–9B are flowcharts illustrating a control method of the washing machine according to the present invention, which is applied to a dehydrating step.
Figure 9B:
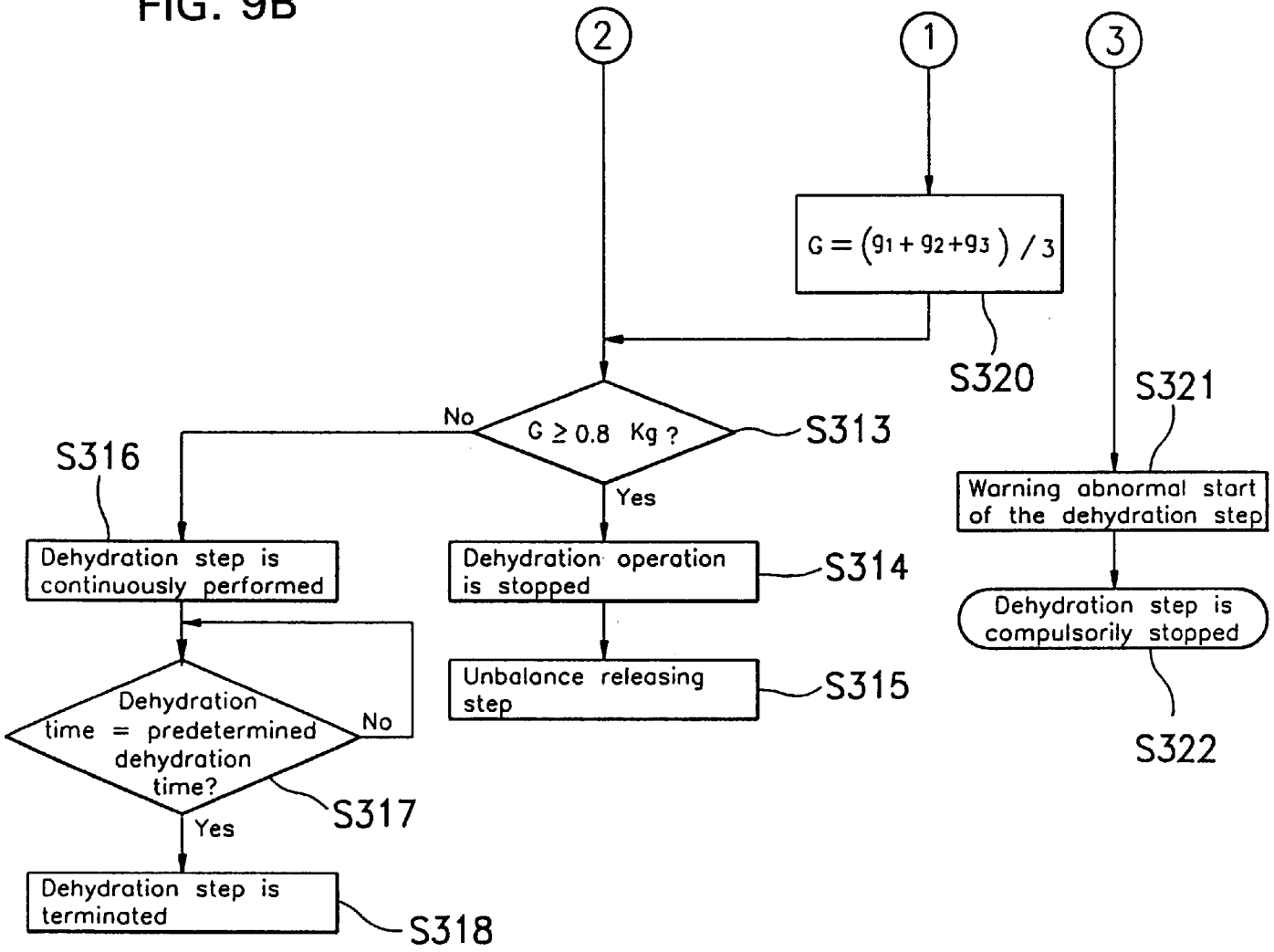

As shown in FIGS. 9A–9B, if the dehydration step starts (S301), the control unit 200 determines the weight x of the water tub 42 by using the hybrid sensor 100 (S302), the dehydration time Tb is calculated on the basis of the sensed weight x (S303).

At this time, in order to calculate the dehydration time Tb, an equation K=(x−Al)/Al is used, where K indicates the load applied to the water tub 42, and Al indicates a laundry weight.

The laundry weight Al is the laundry weight determined in the step S104. The weight x of the water tub 42 includes the weight of the laundries absorbing the water. Accordingly, the variable K indicates a water absorbing degree of the laundries. Accordingly, if the variable K is a high value, the dehydration time Tb is set to a long time. If the variable K is a low value, the dehydration time Tb is set to a short time.

The control unit 200 outputs a control signal to the washing motor driving portion 45*a*, and performs a first acceleration step for driving the washing motor 45 during a predetermined time (S304). After performing the first acceleration step (S304), a first output voltage P1 of the hybrid sensor 100 is sensed for 5 seconds (S305).

If the first output voltage P1 is sensed in the step S305, a second acceleration step for driving again the washing motor 45 is performed (S306). During the 5 seconds, the second output voltage P2 of the hybrid sensor 100 is sensed (S307). Then, a third acceleration step for driving again the washing motor 45 is performed (S308), and the third output voltage P3 is sensed (S309) during 5 seconds after the third acceleration step.

If the first to third output voltages (P1, P2 and P3) are obtained, the control unit 200 reads the output voltages P1–P3 via its A/D conversion terminal, converts each of the output voltages P1–P3 to digital signals, and compares the converted digital signal with a predetermined reference voltage to determine an unbalance. If the converted digital signal is over the predetermined reference voltage, each of the output voltages P1–P3 is converted to the unbalance weight (S310) by using the hybrid sensor 100's output voltage per a predetermined reference load (e.g., 0.1 Kg). Herein, the first output voltage P1 is converted to the first unbalance weight g1, the second output voltage P2 is converted to the second unbalance weight g2, and the third output voltage P3 is converted to the third unbalance weight g3.

The control unit 200 uses an equation g1=g2±5% in order to determine whether the first unbalance weight g1 and the second unbalance weight g2 are within the limit of error (S311).

If the equation g1=g2±5% is satisfied in the step S311, the control unit 200 calculates (S312) an average unbalance weight G by using an equation G=(g1+g2)/2.

If the average unbalance weight G is calculated in the step S312, the control unit 200 compares (S313) the average unbalance weight G with a predetermined reference unbalance weight (e.g., 0.8 Kg). Herein, the predetermined reference unbalance weight is determined by the control unit 200, in order to determine whether an unbalance degree is very strong such that the dehydration step should be compulsorily stopped, or an unbalance degree is proper such that dehydration step can be continuously performed.

If the average unbalance weight G is over the reference unbalance weight 0.8 Kg in the step S313, the control unit 200 outputs a control signal to a washing motor driving portion 45*a*, stops the washing motor 45 (S314), and then performs an unbalance releasing step (S315) to solve this unbalance state. This unbalance releasing step S315 performs again a rinsing step to solve a state of the unevenly-placed laundries, performs again the drain operation, and achieves a normal dehydration step.

If the average unbalance weight G is below the reference unbalance weight 0.8 Kg in the step S313, the control unit 200 determines an unbalance state capable of continuously performing the dehydration step, and continuously performs a dehydration step by accelerating the washing motor 45 (S316).

Then, the control unit 200 determines (S317) whether a dehydration time reaches to the predetermined dehydration time Tb of the step S303. If the present dehydration time reaches to the predetermined dehydration time Tb in the step S317, the control unit 200 outputs a control signal to the washing motor driving portion 45*a*, stops the washing motor 45, and stops the dehydration step (S318).

In the meantime, the equation g1=g2±5% is not satisfied in the step S311, the control unit 200 compares (S319) the first unbalance weight g1 with the third unbalance weight g3, and compares the second unbalance weight g2 with the third unbalance weight g3, by using another equations g1=g3±5% and g2=g3±5%. As a result, the control unit determines whether each unbalance weight is within the limit of the error.

If the equations g1=g3±5% and g2=g3±5% are satisfied in the step S319, the control unit calculates (S320) an average unbalance weight G by using an equation G=(g1+g2+g3)/3. Then, the average unbalance weight G is compared with the reference unbalance weight 0.8 Kg in the step S313, in order to determine whether the dehydration step is continuously performed. According to the result of the step 313, the control unit 200 proceeds the steps (S314–S315) or the steps (S316–S318).

However, if the equations g1=g3±5% and g2=g3±5% are not satisfied in the step S319, this means that the measured three unbalance quantities g1–g3 are out of the allowable error limit. This case occurs when there is an abnormal state in the unbalance sensing apparatus. Accordingly, the control unit 200 stops the washing motor 45 and warns the user of this abnormal state through the warning portion 203 (S321), and then stops the dehydration step (S322).

As described above, the washing machine having the hybrid sensor senses the laundry weight, the feed water weight, and the unbalance weight by using only one hybrid sensor, has a simple structure, and easily performs a signal processing.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. In a washing machine including a main body; a water tub provided to inside of the main body; a washing tub rotatably mounted to inside of the water tub; and at least one suspension bar having an upper end coupled with an inner wall of the main body and a lower end coupled with an outer wall of the water tub, and supporting the water tub, the washing machine comprising:

a hybrid sensor which is mounted to the upper end of the suspension bar and generates signals corresponding to a laundry weight, a water level and a dynamic unbalance on the basis of ascending or descending displacement of the suspension bar when the suspension bar is moved up and down by load variation or unbalance rotation of the water tub.

2. The washing machine as set forth in claim 1, wherein the hybrid sensor includes:

a housing;

a permanent magnet vertically moved with the suspension bar in the housing according to load variation of the water tub;

an elastic member which is provided below the permanent magnet and is compressed in proportion to the load applied to the water tub;

a hall element which is disposed so as to face the upper surface of the permanent magnet at a predetermined distance and generates a voltage signal corresponding to the magnetic force varied by the motion of the permanent magnet;

a signal amplifier for amplifying the voltage signal generated from the hall element so as to achieve a proper signal processing;

a signal converting portion which receives an amplified voltage signal from the signal amplifier and converts the amplified voltage signal, which is in inverse proportion to the distance between the permanent magnet and the hall element, to be in proportion to the distance; and an output line for outputting an output signal of the signal converting portion to the outside.

3. The washing machine as set forth in claim 2, wherein the hybrid sensor further includes:

a printed circuit board which contains the hall element, the signal amplifier and the signal converting portion therein and is fixedly mounted to the inside of the housing; and a cover which is provided to the top of the housing to cover the inside of the housing.

4. The washing machine as set forth in claim 3, wherein the hybrid sensor further includes:

a first projection to mount the printed circuit board, and a second projection provided on the first projection to mount the cover thereon, in the inside of an upper part of the housing.

5. The washing machine as set forth in claim 2, wherein:

the permanent magnet and the upper end of the suspension bar are coupled to each other by a reception member, the reception member including: a seating member for seating the permanent magnet; and a hollow coupling rod which is extended from a lower part of the seating member, and is coupled with the upper end of the suspension bar.

6. The washing machine as set forth in claim 5, wherein:

the hollow coupling rod horizontally provides a pin hole to its lower part, the pin hole inserting a fixing pin therein.

7. The washing machine as set forth in claim 5, wherein:

a sealing member is provided between an outer circumference of the coupling rod and an inner circumference of the housing.

8. The washing machine as set forth in claim 2, wherein:

the hybrid sensor outputs a linear voltage signal according to the load applied to the suspension bar.

9. In a washing machine including: a main body; a water tub provided to inside of the main body; a washing tub rotatably mounted to inside of the water tub; at least one suspension bar for supporting the water tub; and a hybrid sensor which generates an electric signal in response to an ascending or descending displacement of the suspension bar, a method for controlling the washing machine having the hybrid sensor, comprising the steps of:

a) if a plurality of laundries are initially put into the washing tub after a power-supply is applied to the washing machine, sensing an initial output voltage of the hybrid sensor, and determining a weight of the laundries;

b) determining an optimum feed water weight corresponding to a sensed laundry weight;

c) if the output voltage of the hybrid sensor raises due to a water supply step start, determining a voltage difference between a raised output voltage and the initial output voltage as the present feed water weight, and continuously performing a water supply step until the optimum feed water weight is satisfied;

d) if the output voltage of the hybrid sensor is lowered due to a drain step start, determining a lowered output voltage as a present drain weight, and continuously performing the drain step until the completion of the drain operation is determined; and e) if a dehydration step starts after the drain step, sensing an output voltage of the hybrid sensor due to a suspension bar's displacement generated in a plurality of intermittent dehydration steps involved in the dehydration step, determining whether there is an unbalance by using the output voltage of the hybrid sensor, and controlling a dehydration operation.

10. The method as set forth in claim 9, wherein the step(a) includes the steps of:

sensing an initial output voltage of the hybrid sensor before putting the laundries into the washing tub;

if the laundries is put into the washing tub, sensing a raised output voltage of the hybrid sensor; and sensing a laundry weight by using a voltage difference between the initial output voltage and the raised output voltage.

11. The method as set forth in claim 9, wherein the step(c) includes the steps of:

sensing an initial output voltage of the hybrid sensor before starting a water supply operation, and counting a water supply time simultaneously with starting the water supply operation;

if the output voltage of the hybrid sensor raises due to the water supply operation, comparing the initial output voltage with the raised output voltage, and sensing the present feed water weight;

determining whether the sensed present feed water weight reaches to a reference feed water weight for calculating a water supply finishing time;

measuring a duration time until the present feed water weight reaches to the reference feed water weight, and determining the water supply finishing time; and if the present feed water weight reaches to the optimum feed water weight or the counted water supply time reaches to the water supply finishing time, stopping the water supply operation.

12. The method as set forth in claim 9, wherein the step(d) includes the steps of:

sensing an initial output voltage of the hybrid sensor, and previously determining a drain finishing time;

counting a drain time simultaneously with starting a drain operation;

if the output voltage of the hybrid sensor is lowered due to the drain operation, comparing the initial output voltage with the lowered output voltage, and sensing a present drain weight;

determining whether the sensed present drain weight reaches to a drain completion reference value for determining the completion of the drain operation; and if the present drain weight reaches to the drain completion reference value or the counted drain time reaches to the drain finishing time, stopping the drain operation.

13. The method as set forth in claim 9, wherein the step(e) includes the steps of:

sensing a weight of the water tub by using an output signal of the hybrid sensor;

calculating a dehydration time on the basis of the sensed weight of the water tub;

sensing a first output voltage of the hybrid sensor in a first intermittent dehydration step;

sensing a second output voltage of the hybrid sensor in a second intermittent dehydration step;

sensing a third output voltage of the hybrid sensor in a third intermittent dehydration step;

determining whether the first to third output voltages are beyond a predetermined reference voltage for determining an unbalance;

if the first to third output voltages are beyond the predetermined reference voltage, converting the first output voltage to a first unbalance weight, converting the second output voltage to a second unbalance weight, and converting the third output voltage to a third unbalance weight;

determining whether the first to third unbalance quantities are within a limit of error, calculating an average unbalance weight, and comparing the average unbalance weight with a predetermined reference unbalance weight; and performing an unbalance releasing step when the average unbalance weight is beyond the reference unbalance weight, and continuously performing a dehydration step when the average unbalance weight is below the reference unbalance weight.

* * * * *